US010822910B2

(12) United States Patent
Doane

(10) Patent No.: US 10,822,910 B2
(45) Date of Patent: Nov. 3, 2020

(54) PACKER AND SYSTEM

(71) Applicant: James Doane, Friendswood, TX (US)

(72) Inventor: James Doane, Friendswood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 183 days.

(21) Appl. No.: 16/052,155

(22) Filed: Aug. 1, 2018

(65) Prior Publication Data

US 2020/0040691 A1 Feb. 6, 2020

(51) Int. Cl.

| | |
|---|---|
| ***E21B 33/122*** | (2006.01) |
| ***E21B 33/12*** | (2006.01) |
| ***E21B 17/02*** | (2006.01) |
| ***E21B 43/12*** | (2006.01) |

(52) U.S. Cl.

CPC ..... *E21B 33/122* (2013.01); *E21B 17/023* (2013.01); *E21B 33/1208* (2013.01); *E21B 43/128* (2013.01)

(58) Field of Classification Search

CPC ..... E21B 33/122; E21B 33/04; E21B 33/129; E21B 17/10; E21B 17/00; E21B 17/02; E21B 17/042; E21B 43/12; E21B 43/128; E21B 17/023; E21B 17/041; E21B 43/13; G01V 1/22; H01R 13/52; H01R 13/5205; H01R 13/5208

See application file for complete search history.

(56) References Cited

U.S. PATENT DOCUMENTS 2,304,303 A * 12/1942 Ferguson ..... E21B 34/12 166/128
4,258,787 A * 3/1981 Amancharla ..... E21B 33/122 166/120
4,387,767 A * 6/1983 Read ..... E21B 33/122 166/120

(Continued)

FOREIGN PATENT DOCUMENTS

WO 2017091813 A1 6/2017

OTHER PUBLICATIONS

International Search Report for International Application No. PCT/US2019/038378, International Filing Date Jun. 21, 2019, dated Oct. 2, 2019, 3 pages.

(Continued)

*Primary Examiner* — George S Gray
(74) *Attorney, Agent, or Firm* — Cantor Colburn LLP

(57) ABSTRACT

A packer including a body having a first axial end and a second axial end, an element disposed about the body, and a flow passage within the body extending from the first axial end to the second axial end. The body defines a first pathway including a first port dimensioned and configured to receive a first penetrator and a second opening having a dimension smaller than the first port, the first port being located at the first axial end of the body and the second opening being located at the second axial end of the body. A second pathway defined by the body includes a second port dimensioned and configured to receive a second penetrator and a first opening having a dimension smaller than the second port, the second port being located at the second axial end of the body and the first opening being located at the first axial end of the body.

13 Claims, 3 Drawing Sheets

(56) References Cited

U.S. PATENT DOCUMENTS

| | | | | |
|---|---|---|---|---|
| 4,606,410 | A * | 8/1986 | Becker | E21B 23/03 166/117.5 |
| 4,753,604 | A | 6/1988 | Wheeler | |
| 6,727,828 | B1 | 4/2004 | Malone et al. | |
| 2007/0274849 | A1* | 11/2007 | Martinez | E21B 43/128 417/423.3 |
| 2009/0183870 | A1* | 7/2009 | Leitch | E21B 43/128 166/244.1 |
| 2015/0233204 | A1 | 8/2015 | Tarlton et al. | |
| 2015/0354315 | A1 | 12/2015 | Windegaard et al. | |
| 2018/0347287 | A1* | 12/2018 | Emerson | H01R 13/5205 |

OTHER PUBLICATIONS

Written Opinion of the International Search Authority for International Application No. PCT/US2019/038378, International Filing date Jun. 21, 2019, dated Oct. 2, 2019, 5 pages.

* cited by examiner

PACKER AND SYSTEM

BACKGROUND

In the resource recovery industry control of installations such as wellbore completions is important for safety and environmental concerns. Packers are often used in the wellbore environment to provide such control and for other reasons. In the event devices are to be employed downhole of a packer, there may be a need to penetrate packers in order for cables and lines to reach devices downhole of the packer that are intended to be employed with the cables or lines. Penetrations present potential leak paths and hence industry has grown to address this issue. Penetrators such as those commercially available from companies such as RMS pump tools have become ubiquitous to address the issue of penetrating packers. While they perform extremely well, they do represent a relatively large cross section and hence take up not insignificant "real estate" of the packer. Accordingly, for smaller diameter packers, the art has traditionally been limited to the use of a single penetrator adjacent a flow passage for produced fluids through the packer.

The art would well receive configurations allowing for a greater number of penetrators to be employed in relatively smaller diameter packers.

SUMMARY

A packer including a body having a first axial end and a second axial end; an element disposed about the body; a flow passage within the body extending from the first axial end to the second axial end; a first pathway through the body, the first pathway including a first port dimensioned and configured to receive a first penetrator and a second opening having a dimension smaller than the first port, the first port being located at the first axial end of the body and the second opening being located at the second axial end of the body; and a second pathway through the body, the second pathway including a second port dimensioned and configured to receive a second penetrator and a first opening having a dimension smaller than the second port, the second port being located at the second axial end of the body and the first opening being located at the first axial end of the body.

A wellbore system including a borehole in a subsurface formation; a body having a first axial end and a second axial end disposed in the borehole; an element disposed about the body; a flow passage within the body extending from the first axial end to the second axial end; a first pathway through the body, the first pathway including a first port dimensioned and configured to receive a first penetrator and a second opening having a dimension smaller than the first port, the first port being located at the first axial end of the body and the second opening being located at the second axial end of the body; a first penetrator disposed in the first port; a second pathway through the body, the second pathway including a second port dimensioned and configured to receive a second penetrator and a first opening having a dimension smaller than the second port, the second port being located at the second axial end of the body and the first opening being located at the first axial end of the body; a second penetrator disposed in the second port; and a plurality of devices disposed in the borehole downhole of the body at least two of which being connected to independent signal bearing lines run through the first and second penetrators.

A packer including a body having a first axial end and a second axial end; a first penetrator engaged with the body at the first axial end; and a second penetrator engaged with the body at the second axial end.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
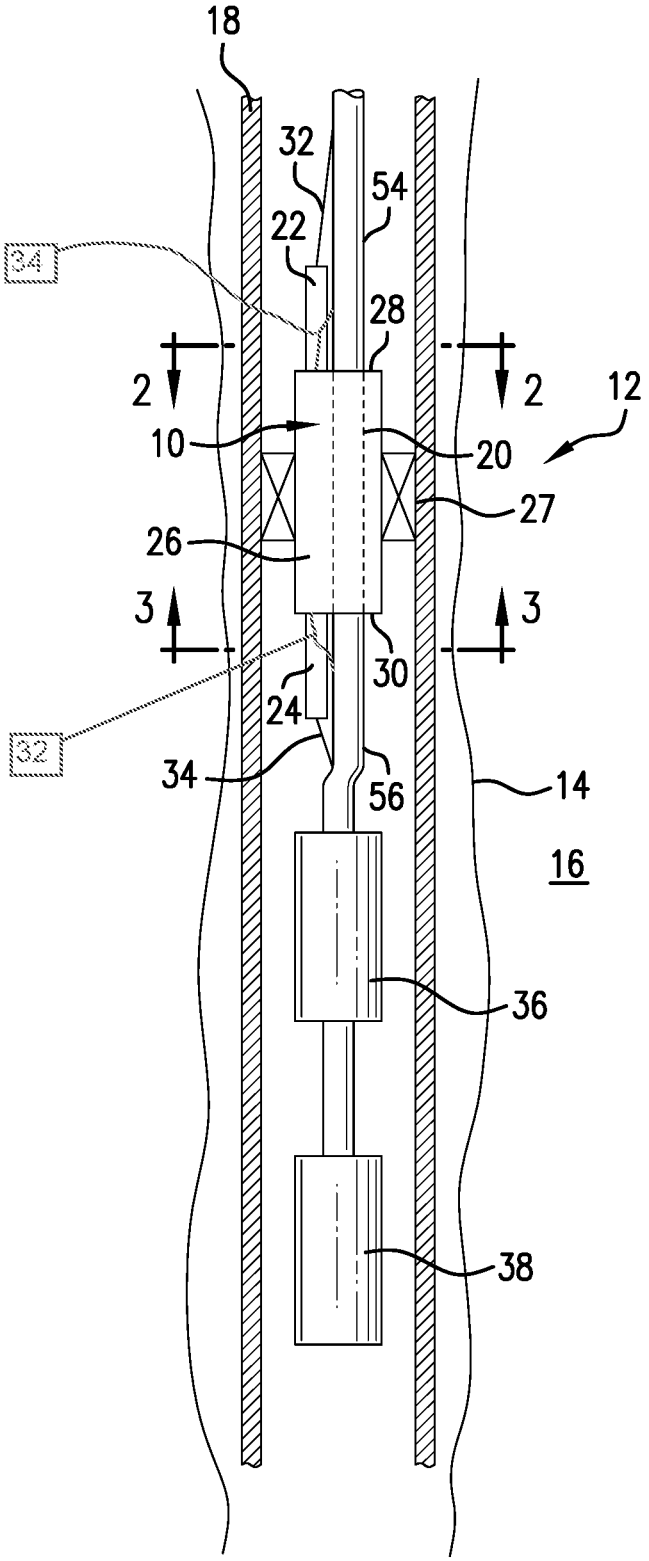
FIG. 1 is a schematic sectional view of a packer as disclosed herein disposed in a section of wellbore.

Referring to FIG. 1, a schematic cross sectional view of a packer 10 as disclosed herein is shown in a portion of a wellbore system 12. The system comprises a borehole 14 in a formation 16. There may be a casing 18 installed in the borehole 14 or the packer 10 may be deployed in open hole. The packer 10 includes a flow passage 20, a first penetrator 22 and a second penetrator 24 disposed within a body 26 of the packer 10 and an element 27 disposed about the body 26. The body 26 extends from a first end 28 and a second end 30, the first end 28 being shown in FIG. 2 and the second end 30 being shown in FIG. 3. It will be understood that the purpose of the penetrators 22 and 24 is to, without leaks, pass a cable or line 32 and 34, respectively, through the packer 10 so that signals, power, etc. may be communicated with a plurality of devices 36 and 38 (two shown but more contemplated) disposed downhole of the packer 10. It will be appreciated by some that a configuration that provides two lines 32 and 34 requires the use of a packer having a greater diameter than some applications otherwise require or permit simply because of the area taken up by the penetrators 22 and 24. It is for these applications that the configurations disclosed herein have great utility.

Figure 2:
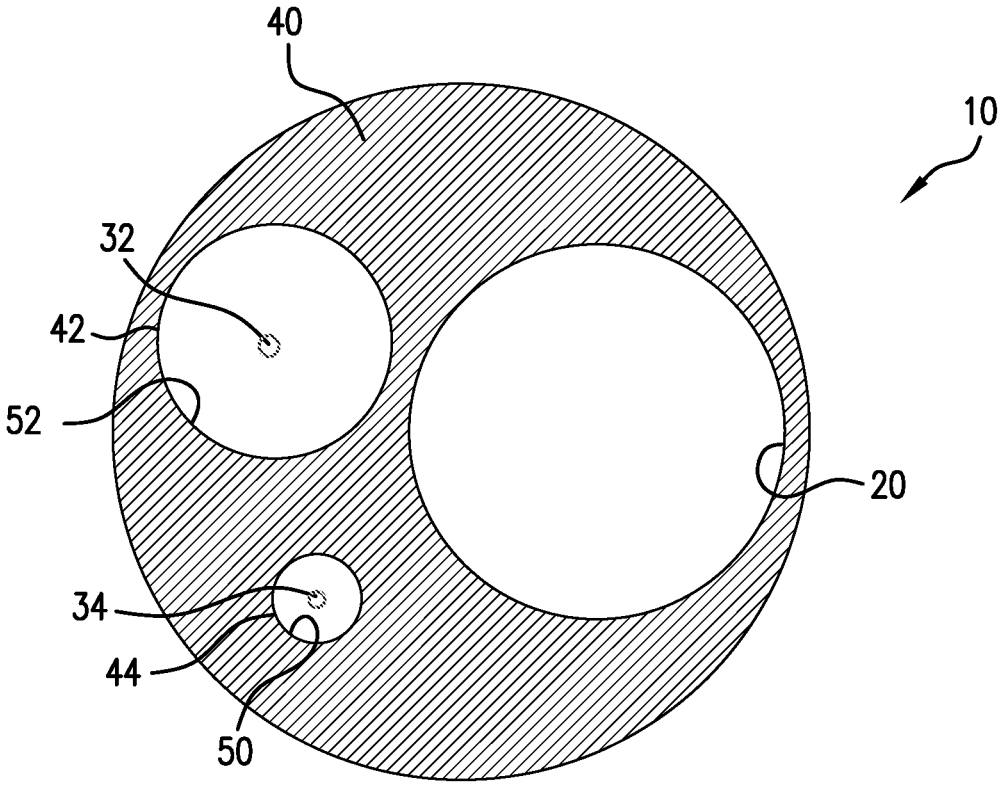
FIG. 2 is a view of FIG. 1 taken along line 2-2 in FIG. 1.
Figure 3:
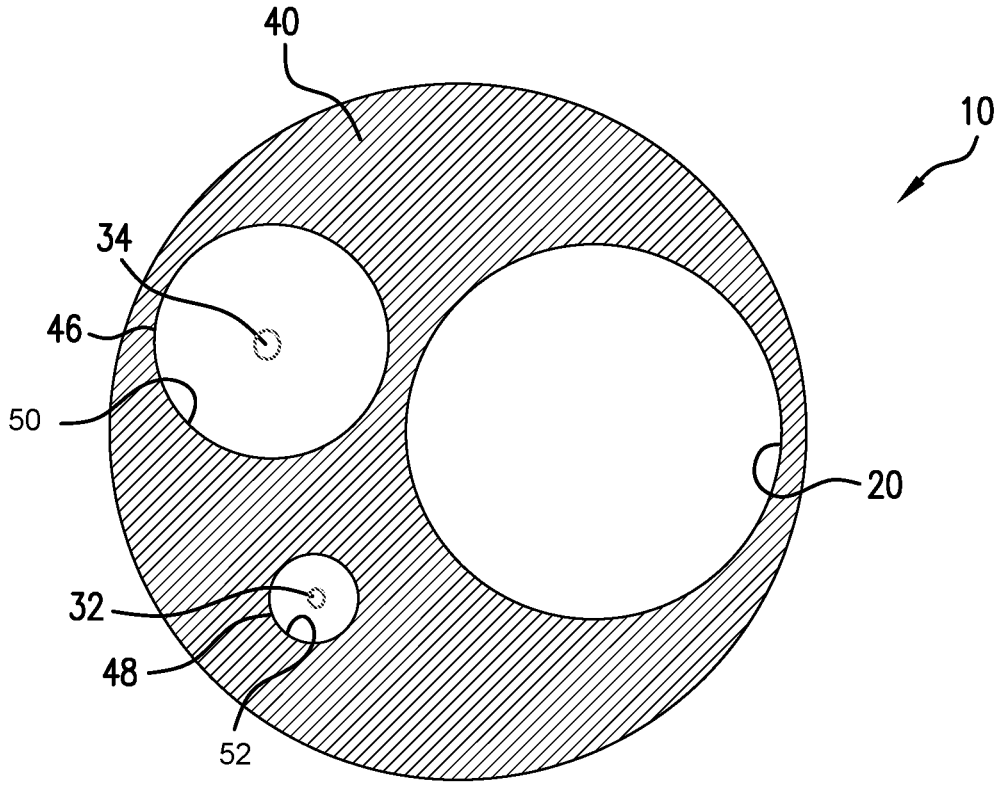
FIG. 3 is a view of FIG. 1 taken along line 3-3 in FIG. 1.

Referring to FIGS. 2 and 3, it is to be understood that a view of an uphole end 28 of the packer (FIG. 2) and a downhole end 30 of the packer 10 (FIG. 3) illustrate the relative positions and the relative sizes of parts of the body 26 of the packer 10. FIGS. 2 and 3 are oriented in the same way that FIG. 1 is oriented such that the flow passage 20 is seen on the right of FIGS. 1, 2 and 3 while a first port 42 and a first opening 44 are leftward of the flow passage 20 in FIG. 2 and a second port 46 and second opening 48 are leftward of the flow passage 20 in FIG. 3. It is to be appreciated that the first port 42 and first opening 44 are not of the same diameter and that similarly the second port 46 and second opening 48 are not of the same diameter. It is also to be understood that the first port 42 and the second opening 48 are connected to one another by a first pathway 52 and the first opening 44 and second port 46 are connected to one another by a second pathway 50. In each case, the ports 42 and 46 are of larger dimension as they are intended to mate with a penetrator 22 and 24, respectively. The openings 44 and 48 however at the other end of each of their pathways 50 and 52 pathways from the ports 46 and 42, respectively, are smaller since they can be so since no penetrator is needed at the locations of the openings 44 and 48 and the real estate is reduced due to the existence of the ports 42 and 46 that are adjacent the openings 44 and 48, respectively.

At the ports 42 and 46, there is provided a threadform receptive of a penetrator, that threadform being in one iteration an API (American Petroleum Institute) threadform. At one or both ends of the flow passage, the body may include threadforms conducive of connecting the body with tubulars 54 and 56 that together may be considered a tubular string.

The body 26 may comprise metal or a composite material. The packer 10 may be a hydraulically set packer such as an Octopus™ hydraulically set and retrievable packer available commercially From Baker Hughes, a GE company Houston, Tex.

Set forth below are some embodiments of the foregoing disclosure:

Embodiment 1

A packer including a body having a first axial end and a second axial end; an element disposed about the body; a flow passage within the body extending from the first axial end to the second axial end; a first pathway through the body, the first pathway including a first port dimensioned and configured to receive a first penetrator and a second opening having a dimension smaller than the first port, the first port being located at the first axial end of the body and the second opening being located at the second axial end of the body; and a second pathway through the body, the second pathway including a second port dimensioned and configured to receive a second penetrator and a first opening having a dimension smaller than the second port, the second port being located at the second axial end of the body and the first opening being located at the first axial end of the body.

Embodiment 2

The packer as in any prior embodiment wherein the flow passage is configured to convey production fluid therethrough.

Embodiment 3

The packer as in any prior embodiment wherein the body is metal.

Embodiment 4

The packer as in any prior embodiment wherein the packer is retrievable.

Embodiment 5

The packer as in any prior embodiment wherein the packer is a hydraulic set packer.

Embodiment 6

The packer as in any prior embodiment wherein the first port includes a threadform receptive to a penetrator.

Embodiment 7

The packer as in any prior embodiment wherein the body includes a thread receptive to a production tubular.

Embodiment 8

The packer as in any prior embodiment wherein the second port includes a threadform receptive to a penetrator.

Embodiment 9

A wellbore system including a borehole in a subsurface formation; a body having a first axial end and a second axial end disposed in the borehole; an element disposed about the body; a flow passage within the body extending from the first axial end to the second axial end; a first pathway through the body, the first pathway including a first port dimensioned and configured to receive a first penetrator and a second opening having a dimension smaller than the first port, the first port being located at the first axial end of the body and the second opening being located at the second axial end of the body; a first penetrator disposed in the first port; a second pathway through the body, the second pathway including a second port dimensioned and configured to receive a second penetrator and a first opening having a dimension smaller than the second port, the second port being located at the second axial end of the body and the first opening being located at the first axial end of the body; a second penetrator disposed in the second port; and a plurality of devices disposed in the borehole downhole of the body at least two of which being connected to independent signal bearing lines run through the first and second penetrators.

Embodiment 10

A system as in any prior embodiment further comprising a tubular string connected to the body.

Embodiment 11

A system as in any prior embodiment wherein the plurality of devices includes two pumps.

Embodiment 12

A system as in any prior embodiment further comprising a casing disposed in the borehole and within which the body is disposed.

Embodiment 13

A system as in any prior embodiment wherein the body is a part of a packer.

Embodiment 14

A packer including a body having a first axial end and a second axial end; a first penetrator engaged with the body at the first axial end; and a second penetrator engaged with the body at the second axial end.

Embodiment 15

The packer as in any prior embodiment further comprising an element disposed about the body.

Embodiment 16

The packer as in any prior embodiment wherein the body includes a flow passage therethrough.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A packer comprising:

a body having a first axial end and a second axial end;

an element disposed about the body;

a flow passage within the body extending from the first axial end to the second axial end;

a first pathway through the body, the first pathway including a first port dimensioned and configured to receive a first penetrator and a second opening having an areal dimension smaller than the first port, the first port being located at the first axial end of the body and the second opening being located at the second axial end of the body; and a second pathway through the body, the second pathway including a second port dimensioned and configured to receive a second penetrator and a first opening having an areal dimension smaller than the second port, the second port being located at the second axial end of the body and the first opening being located at the first axial end of the body, the first port and second port arranged on their respective axial ends such that upon a projection of one axial end on the other axial end the first port and second port overlap.

2. The packer as claimed in claim 1 wherein the flow passage is configured to convey production fluid therethrough.

3. The packer as claimed in claim 1 wherein the body is metal.

4. The packer as claimed in claim 1 wherein the packer is retrievable.

5. The packer as claimed in claim 1 wherein the packer is a hydraulic set packer.

6. The packer as claimed in claim 1 wherein the first port includes a threadform receptive to a penetrator.

7. The packer as claimed in claim 1 wherein the body includes a thread receptive to a production tubular.

8. The packer as claimed in claim 1 wherein the second port includes a threadform receptive to a penetrator.

9. A wellbore system comprising:

a borehole in a subsurface formation;

a body having a first axial end and a second axial end disposed in the borehole;

an element disposed about the body;

a flow passage within the body extending from the first axial end to the second axial end;

a first pathway through the body, the first pathway including a first port and a second opening having an areal dimension smaller than the first port, the first port being located at the first axial end of the body and the second opening being located at the second axial end of the body;

a first penetrator disposed in the first port;

a second pathway through the body, the second pathway including a second port and a first opening having an areal dimension smaller than the second port, the second port being located at the second axial end of the body and the first opening being located at the first axial end of the body, the first port and second port arranged on their respective axial ends such that upon a projection of one axial end on the other axial end the first port and second port overlap;

a second penetrator disposed in the second port; and a plurality of devices disposed in the borehole downhole of the body at least two of which being connected to independent signal bearing lines run through the first and second penetrators.

10. A system as claimed in claim 9 further comprising a tubular string connected to the body.

11. A system as claimed in claim 9 wherein the plurality of devices includes two pumps.

12. A system as claimed in claim 9 further comprising a casing disposed in the borehole and within which the body is disposed.

13. A system as claimed in claim 9 wherein the body is a part of a packer.

* * * * *